US009278542B1

(12) United States Patent
Koehler et al.

(10) Patent No.: US 9,278,542 B1
(45) Date of Patent: Mar. 8, 2016

(54) REPLACEABLE, HIGH-TEMPERATURE, MULTI-CHANNEL, EXTERNALLY ATTACHED FLUIDIC FILTER

(71) Applicant: Xerox Corporation, Norwalk, CT (US)

(72) Inventors: David R. Koehler, Portland, OR (US); Blake T. Weimer, Woodburn, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/754,265

(22) Filed: Jun. 29, 2015

(51) Int. Cl.
*B41J 2/175* (2006.01)
*B41J 2/14* (2006.01)

(52) U.S. Cl.
CPC ..... *B41J 2/17563* (2013.01); *B41J 2/14201* (2013.01)

(58) Field of Classification Search
CPC ..... B41J 2/17563; B41J 2/14201; B41J 2/14233; B41J 14/161
See application file for complete search history.

(56) References Cited

U.S. PATENT DOCUMENTS 7,448,741 B2 * 11/2008 von Essen ..... B41J 2/17563 347/85
8,201,928 B2 * 6/2012 Gerner ..... B41J 2/14233 347/71

* cited by examiner

*Primary Examiner* — Juanita D Jackson
(74) *Attorney, Agent, or Firm* — MH2 Technology Law Group LLP

(57) ABSTRACT

A printhead including a printhead body and a filter assembly that is removably attached to the printhead body with one or more mechanical fasteners. The filter assembly can include at least a first plate, a second plate, and a filter interposed between the first plate and the second plate. The removable filter assembly can be used to filter a single fluid, such as a liquid ink or a gas, or two or more fluids, using one or more filters. The filter assembly can be removed from the printhead body and replaced with a new or different filter assembly.

18 Claims, 7 Drawing Sheets

REPLACEABLE, HIGH-TEMPERATURE, MULTI-CHANNEL, EXTERNALLY ATTACHED FLUIDIC FILTER

TECHNICAL FIELD

The present teachings relate to the field of ink jet printing devices and, more particularly, to a printhead having a filter and a printer including the printhead.

BACKGROUND

Drop-on-demand ink jet technology is widely used in the printing industry. Printers using drop-on-demand ink jet technology can include the use of a printhead that ejects an ink from a plurality of nozzles in a nozzle plate (i.e., aperture plate). Various ejection technologies may be used to eject ink droplets from the plurality of nozzles including, for example, thermal ejection, electrostatic ejection, or piezoelectric ejection.

The manufacture and storage of printheads and ink can generate an amount of debris and contamination within the printhead and ink that can block ink channels within the printhead and the nozzles in the nozzle plate. These blockages can result in poor printer performance and lead to replacement of the printhead. To reduce or prevent blockage of the ink channels and nozzles, the printhead is manufactured to include a particulate filter or "rock screen." The particulate filter is a layer within an interior of the printhead that includes a plurality of holes that are smaller than the anticipated size of the contamination. The particulate filter is typically manufactured as part of a printhead manifold, where the printhead manifold incorporates a plurality of laminated layers including the particulate filter layer. Thus, the particulate filter is built well within the printhead interior. The ink enters a printhead ink inlet from an ink reservoir where it is routed through the ink channels in the upper manifold, through the particulate filter, through the ink channels in the lower manifold, and then ejected from the nozzles in the nozzle plate during printing. The particulate filter is designed to last the lifetime of the printhead.

A particulate filter for an ink jet printhead that has advantages over a conventional particulate filter would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a printhead can include a printhead body having a first ink inlet, a first plurality of ink channels in fluid communication with the first ink inlet, and a nozzle plate including a first plurality of nozzles in fluid communication with the first plurality of ink channels. The printhead may further include a filter assembly removably attached to the printhead body with at least one mechanical fastener, the filter assembly including a first plate including a first ink inlet, a second plate including a first ink outlet in fluid communication with the first ink inlet of the first plate, and a first ink filter interposed between the first plate and the second plate. The first plate, the second plate, and the first ink filter may be attached together, where the first ink outlet is in fluid communication with the first ink inlet of the printhead body.

In another embodiment, a printer can include a printhead body having a first ink inlet, a first plurality of ink channels in fluid communication with the first ink inlet, and a nozzle plate including a first plurality of nozzles in fluid communication with the first plurality of ink channels. The printhead may further include a filter assembly removably attached to the printhead body with at least one mechanical fastener, the filter assembly including a first plate including a first ink inlet, a second plate including a first ink outlet in fluid communication with the first ink inlet of the first plate, and a first ink filter interposed between the first plate and the second plate. The first plate, the second plate, and the first ink filter may be attached together, where the first ink outlet is in fluid communication with the first ink inlet of the printhead body. The printer can further include a housing that houses the printhead.

BRIEF DESCRIPTION OF THE DRAWINGS

The accompanying drawings, which are incorporated in, and constitute a part of this specification, illustrate embodiments of the present teachings and, together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

As discussed above, a conventional particulate filter for an ink jet printhead is formed within an interior of the printhead and is designed to last the lifetime of the printhead. However, the particulate filter area is limited by the cross-sectional area of the printhead reservoir, as well as by the location and space requirements of, for example, other internally packaged printhead components, fluid paths, and air paths. Conventional particulate filters thus have a finite capacity per unit area for holding debris, and a finite functional life for a given size. The functional life of the filter thereby limits the functional life of the printhead, which will vary with different fluids and printheads of varying particle content. Printhead performance decreases once the filter capacity has been exhausted, at which time the printhead must be replaced. Replacement of the printhead is expensive and may lead to decreased customer satisfaction and brand loyalty.

An embodiment of the present teachings includes a printhead having a removable and consumer-replaceable particulate filter (i.e., an ink filter), where the lifetime of the ink filter does not limit the lifetime of the printhead. Further, the capacity of the ink filter is not limited by available space within the interior of the printhead, nor by the location of ink channels within the interior of the printhead. A printhead according to the present teachings includes a filter assembly such as an external filter assembly (EFA) that is mechanically attached to a printhead body, wherein the printhead body includes the printhead manifold and a nozzle plate attached to the printhead body. The EFA may be separated from the printhead manifold once the EFA has become blocked with debris and contamination, or becomes otherwise unsuitable as a filter.

Figure 1:
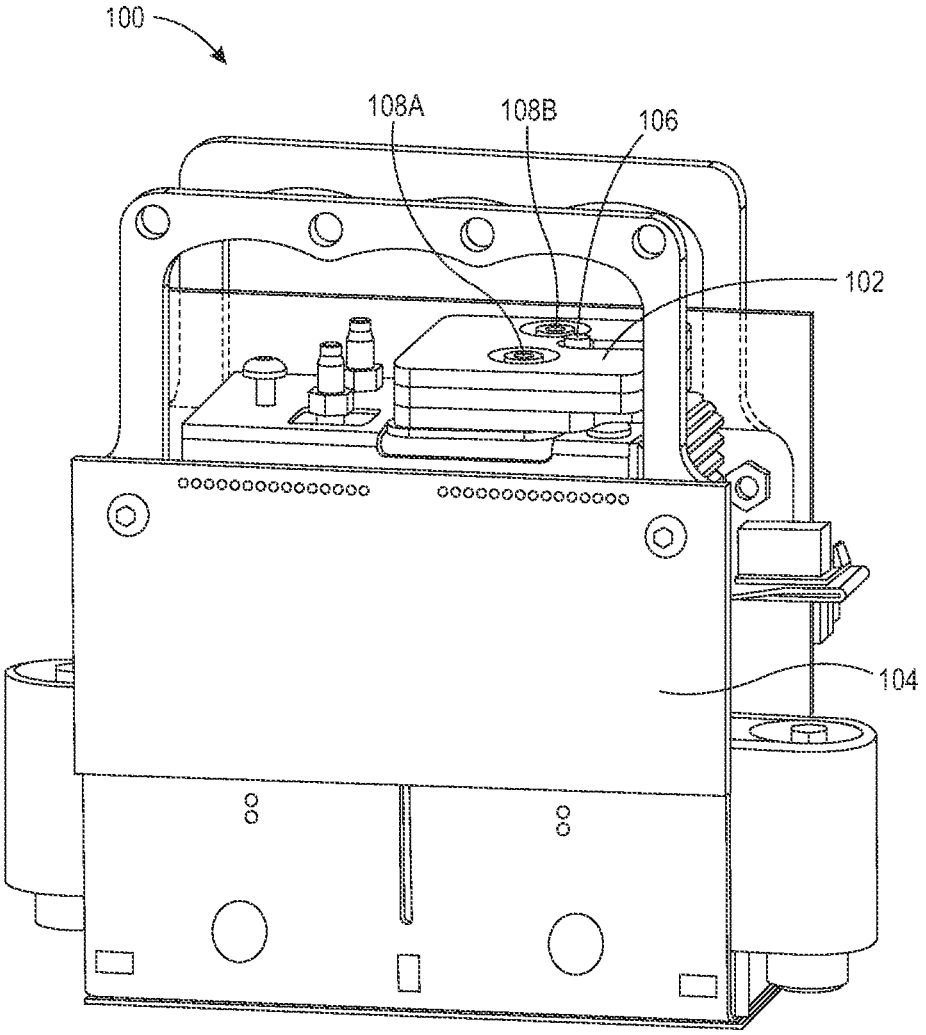
FIG. 1 is a perspective depiction of a printhead in accordance with an embodiment including a printhead body and a removable external filter assembly.

FIG. 1 is a perspective depiction of a printhead 100 and an attached, replaceable EFA 102. It will be apparent to one of ordinary skill in the art that the structures depicted in the FIGS. represent generalized schematic illustrations and that other structures or elements may be added or existing structures or elements may be removed or modified.

Figure 2:
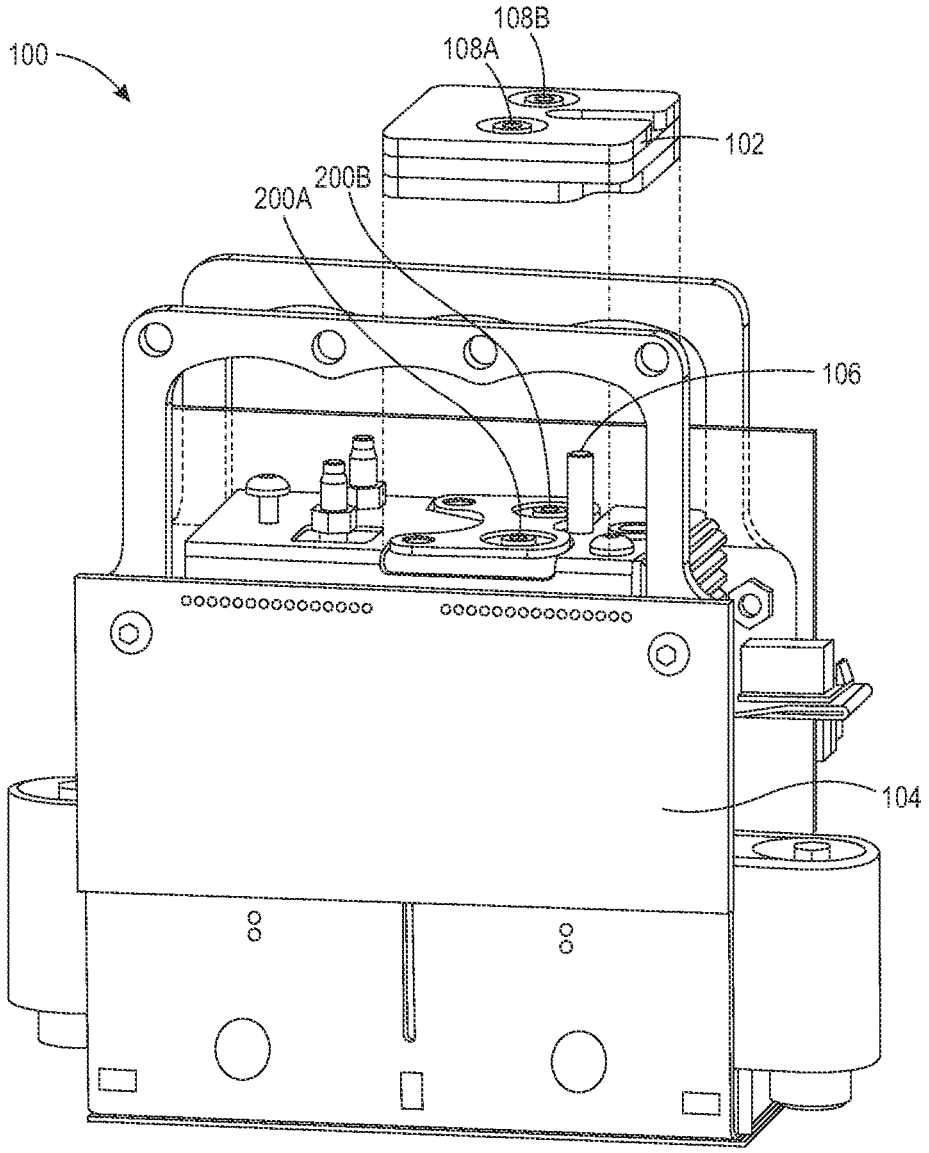
FIG. 2 is an exploded perspective view of the FIG. 1 printhead depicting the external filter assembly removed from the printhead body.
Figure 3:
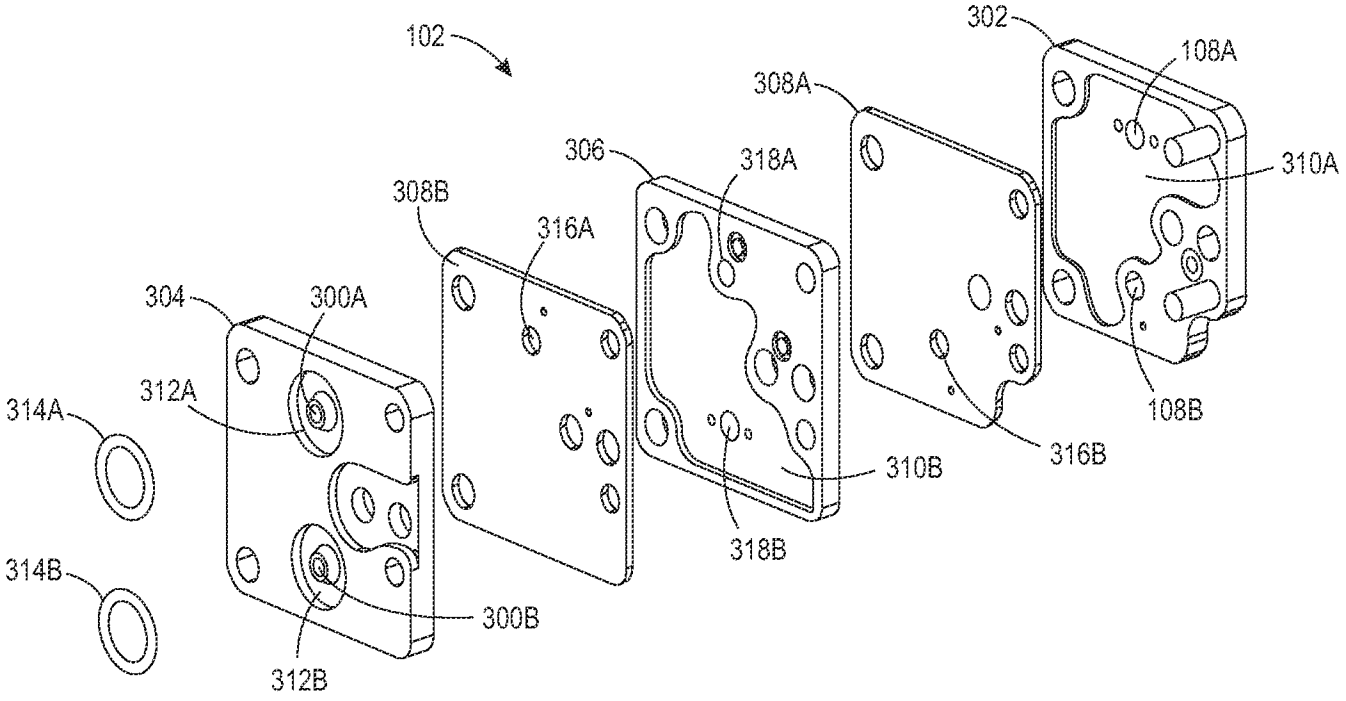
FIG. 3 is an exploded perspective depiction of the external filter assembly having two filters that filter two ink types in accordance with an embodiment.

The EFA 102 is removably attached to, and in fluid communication with, a printhead body 104 of the printhead 100. In an embodiment, the EFA 102 is removably attached to the printhead body 104 using at least one (i.e., one or more) mechanical fasteners 106 such as bolts, pins, clamps, etc. The EFA 102 includes at least one EFA ink inlet 108, where each EFA ink inlet 108 may be in fluid communication with at least one ink reservoir (not individually depicted for simplicity) that is external to the EFA 102 and printhead body 104. Each EFA ink inlet 108 may allow the introduction and filtering of a different ink, for example two different ink compositions, viscosities, and/or colors, into the EFA 102. FIGS. 1-3 depict an EFA 102 having two EFA ink inlets 108A, 108B that correspond to two different ink types (i.e., inks with different colors, viscosities, compositions, etc.). However, it will be appreciated that EFA designs for filtering only one ink, or more than two inks, are contemplated. EFA's that are capable of filtering two or more different types of inks are referred to herein as a "multi-channel" filter, while an EFA that filters only one type of ink is referred to herein as a "single-channel" filter.

Figure 4:
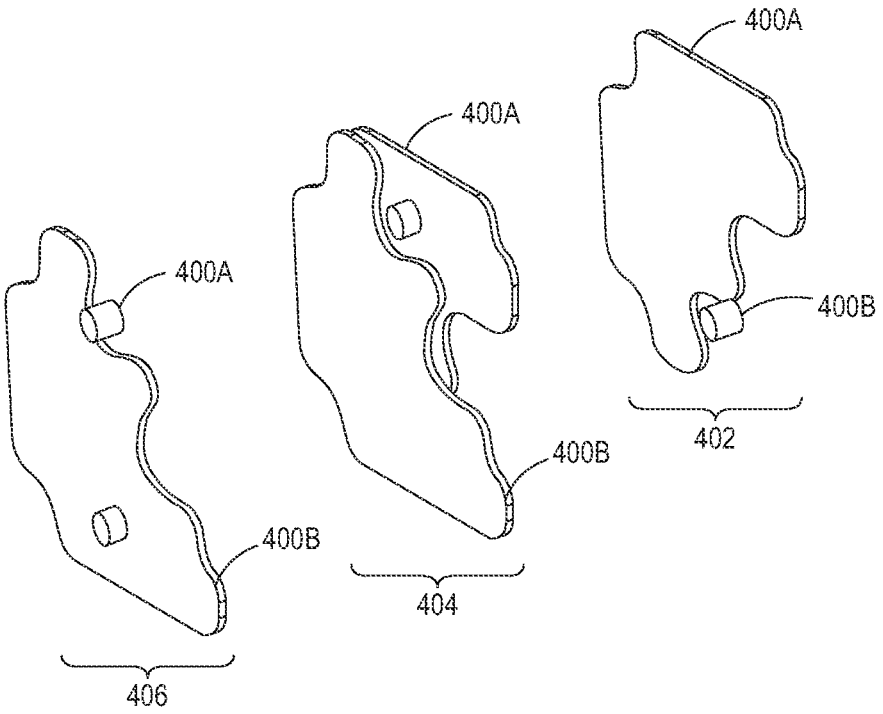
FIG. 4 is an exploded perspective depiction of a first ink and a second ink within the external filter assembly during printing or storage.

Throughout this document, a reference number ending in "A" is a structure that corresponds to, channels, or identifies, a first ink, for example first ink 400A as depicted in FIG. 4, and a reference number ending is "B" is a structure that corresponds to, channels, or identifies, a second ink, for example second ink 400B.

FIG. 2 is an exploded perspective depiction of the printhead 100 including the printhead body 104 and EFA 102. FIG. 2 further depicts a printhead body first ink inlet (i.e., a first fluid inlet) 200A and a printhead body second ink inlet (i.e., a second fluid inlet 200B that are in fluid communication with the EFA ink inlets 108A, 108B and EFA ink outlets 300A, 300B (FIG. 3) respectively.

FIG. 3 is an exploded perspective depiction of an embodiment of the EFA 102. In this embodiment, the EFA 102 includes an EFA first ink inlet (i.e., a first fluid inlet) 108A that channels the first ink 400A, where the EFA first ink inlet 108A is defined by an EFA first plate 302. The EFA 102 further includes an EFA second ink inlet (i.e., a second fluid inlet) 108B that channels the second ink 400B, where the EFA second ink inlet 108B is also defined by the EFA first plate 302. The depicted EFA 102 further includes an EFA first ink outlet 300A that channels the first ink 400A, where the EFA first ink outlet 300A is defined by an EFA second plate 304. FIG. 3 also depicts an EFA second ink outlet 300B that channels the second ink 400B, where the EFA second ink outlet 300B is also defined by the EFA second plate 304. A third EFA plate 306 is interposed between the EFA first plate 302 and the EFA second plate 304. The reverse sides of the EFA second plate 304 and the EFA third plate 306 (not visible in the FIG. 3 depiction) may be flat, or may include one or more cavities, depending on the design. The EFA 102 of FIG. 3 includes a first ink filter 308A that filters the first ink 400A and a second ink filter 308B that filters the second ink 400B. The first ink filter 308A is interposed between the EFA first plate 302 and the third EFA plate 306, while the second ink filter 308B is interposed between the EFA second plate 304 and the third EFA plate 306.

The EFA first plate 302 can include a first ink cavity 310A and the third EFA plate 306 can further include a second ink cavity 310B. The EFA second plate 304 can include a first recess 312A that receives a first seal 314A, and a second recess 312B that receives a second seal 314B. Each of the seals 314A, 314B may be, for example, an O-ring formed from a flexible material such as a high-temperature silicone or other flexible polymer, or another suitable synthetic or natural material.

In this embodiment, the second ink filter 308B, at least in part, defines a first ink passthrough channel 316A and the first ink filter 308A defines, at least in part, a second ink passthrough channel 316B. The first ink passthrough channel 316A allows the first ink 400A to be channeled from the third EFA plate 306, through the first ink passthrough channel 316A in the second filter 308B, to the EFA second plate 304 without being filtered by the second filter 308B. Similarly, the second ink passthrough channel 316B allows the second ink 400B to be channeled from the EFA first plate 302, through the second passthrough channel 316B in the first filter 308A, to the third EFA plate 306 without being filtered by the first filter 308A. FIG. 3 also depicts a third plate first ink outlet 318A in fluid communication with the first ink passthrough channel 316A, and a third plate second ink outlet 318B in fluid communication with the second ink passthrough channel 316B.

FIG. 4 is an exploded perspective depiction of the first ink 400A and the second ink 400B as they appear when they are within the EFA 102, with all other structures removed. In FIG. 4, the first filter 308A (FIG. 3) is interposed between the ink portion 402 and ink portion 404, while the second filter 308B is interposed between ink portion 404 and ink portion 406. The ink portions depicted at 402 are both unfiltered. At 404, first ink 400A is filtered while second ink 400B is unfiltered. The ink portions depicted at 406 are both filtered.

Figure 5:
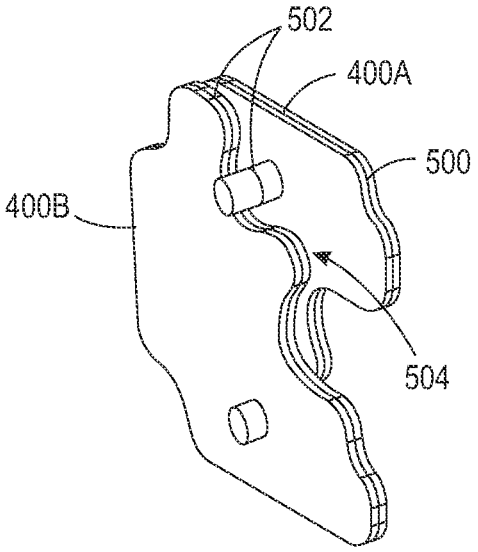
FIG. 5 is an assembled perspective depiction of the FIG. 4 view.

FIG. 5 is an assembled perspective depiction of the FIG. 4 ink structure with other structures removed. In FIG. 5, the first filter 308A is located at 500, the second filter 308B is located at 502, and the third EFA plate 306 is located at 504.

During operation of the EFA 102, the first ink 400A is introduced into the EFA first ink inlet 108A under the influence of an upstream positive pressure. Due to the resistance of the flow of the first ink 400A through the first filter 308A, the first ink 400A first flows into, and fills, the first ink cavity 310A in the EFA first plate 302. Once the first ink 400A fills the first ink cavity 310A, continued pressure forces the first ink 400A through the first filter 308A, which filters the first ink 400A. The first ink 400A then flows through the EFA third plate 306, out of the third plate first ink outlet 318A, through the first ink passthrough channel 316A in the second filter 308B, and through the EFA second plate 304. Subsequently, the first ink 400A flows out of the EFA first ink outlet 300A and into the printhead body first ink inlet 200A, where it is routed to, and ejected from, one or more of the nozzles 712 (FIG. 7) in the nozzle plate 710 according to known techniques.

During a printing operation, the second ink 400B is introduced into the EFA second ink inlet 108B under the influence of an upstream positive pressure. The second ink 400B flows through the second ink passthrough channel 316B in the first filter 308A without being filtered, and then out of the third plate second ink outlet 318B. Due to the resistance of the flow of the second ink 400B through the second filter 308B, the second ink 400B first flows into, and fills, the second ink cavity 310B in the EFA third plate 306. Once the second ink 400B fills the second ink cavity 310B, continued pressure forces the second ink 400B through the second filter 308B, which filters the second ink 400B. The second ink 400B then flows through the EFA second ink outlet 300B and into the printhead body second ink inlet 200B, where it is routed to ink channels 708 (FIG. 7) in the printhead body 104 and ejected from one or more of the nozzles 712 in the nozzle plate 710 according to known techniques.

The first seal 314A and the second seal 314B may reduce or prevent leakage of the first ink 400A and the second ink 400B respectively from between the EFA 102 and the printhead body 104 during the transfer of ink from the EFA 102 to the printhead body 104.

During operation of the printhead 100, the first ink 400A is located within the first ink inlet 108A and the first ink cavity 310A of the first plate 302, the third plate first ink outlet 318A defined by the EFA third plate 306, the first ink passthrough channel 316A defined by the second filter 308B, the first ink outlet 300A of the second plate 304, and the first ink inlet 200A of the printhead body 104. Similarly, the second ink 400B is located within the second ink inlet 108B of the first plate 302, the second ink passthrough channel 316B defined by the first filter 308A, the second ink cavity 310B defined by the third plate 306, the second ink outlet 300B of the second plate 304, and the second ink inlet 200B of the printhead body 104.

Because the EFA 102 is a separate subassembly from the printhead manifold in the printhead body 104, the ink filter area is not limited by the cross-sectional area of the printhead reservoir, nor by the location and space requirements of, for example, other internally packaged printhead body components, fluid paths, or air paths. The first ink cavity 310A and the second ink cavity 310B allow the inks 400A, 400B respectively to physically contact a large area of the filters 308A, 308B respectively before they are filtered. Thus almost the entire area of the filters 308A, 308B are used for filtering. The relatively large surface area filters 308A, 308B thereby decrease clogging compared to filtering across a smaller surface area such as a conventional printhead particulate filter that is formed within a small area of the printhead manifold. While the filter area of an embodiment will depend on the filter design, a EFA filter in an embodiment of the present teachings may have a filtering area of from about 645 $mm^2$ or higher for each ink type 400A, 400B. In an embodiment, the EFA may provide a filter 308 having a filter surface area that is six times the filter surface area of a conventional filter within the same footprint. However, it will be understood that a filter having a smaller or even larger filter surface area may also be designed in accordance with an embodiment of the present teachings, and filter embodiments having other areas, either larger or smaller than 645 $mm^2$, are also contemplated.

Once the EFA 102 has reached its end of life, which may be because of filter clogging, a routine maintenance schedule, or because of other factors, the EFA 102 may be removed and replaced with a new or otherwise different EFA, for example by the printer user. In an embodiment, the one or more mechanical fasteners 106 are unbolted, unpinned, unclamped, etc., to allow the separation and removal of the EFA 102 from the printhead body 104. The replacement EFA is then attached to the printhead body 104 using the one or more mechanical fasteners 106, and printing may then be resumed. In an embodiment, the EFA 102 may be returned to the factory for reconditioning, where the EFA 102 is disassembled, the filters 308A, 308B are replaced, and the reconditioned EFA 102 is reused. In another embodiment, the depleted EFA 102 may be discarded or recycled.

The EFA plates 302-306 may be manufactured from a metal such as steel, aluminum, etc., or a polymer that can withstand temperatures encountered during use, for example, 150° C. or above. The filters 308 may be manufactured from a stainless steel mesh, or another sufficient natural or synthetic porous material. The plates 302-306 and the filters 308 may be laminated together using conventional stack and glue operations, for example, by applying heat and pressure with a press to cure the bonding agent. In an embodiment, a liquid adhesive such as Sylgard® available from Dow Corning of Midland, Mich., may be dispensed onto the plates 302-306 and filters 308 in a pattern matching ridges that define the fluidic cavities 310A, 310B. The plates 302-306 and filters 308 are then stacked and clamped under pressure, then the adhesive (not individually depicted for simplicity) is cured in an oven at sufficient temperatures. In another embodiment, a pressure-sensitive adhesive may be die cut to size and then clamped under pressure to bond the EFA 102 together.

In the embodiment of FIGS. 1-5, each of the EFA first ink inlet 108A, the first ink cavity 310A, the third plate first ink outlet 318A, the first ink passthrough channel 316A, the EFA first ink outlet 300A, the printhead body first ink inlet 108A, a first plurality of ink channels 708A (FIG. 7), and a first plurality of nozzles 712A are in fluid communication, each with the others. Additionally, each of the EFA second ink inlet 108B, the second ink passthrough channel 316B, the third plate second ink outlet 318B, the second ink cavity 310B, the EFA second ink outlet 300B, the printhead second ink inlet 108B, a second plurality of ink channels 708B (FIG. 7), and a second plurality of nozzles 712B are in fluid communication, each with the others. The ink paths for each of the first ink 400A and the second ink 400B are separate and not in fluid communication with each other such that the ink types do not intermix in embodiments using two or more ink types. Thus in FIG. 3, the first filter 308A filters the first ink 400A but not the second ink 400B, and the second filter 308B filters the second ink 400B but not the first ink 400A.

In FIGS. 1-3, the EFA 102 may use one filter 308 for each ink type 400, which allows the filtering area for each ink type to be large, such that clogging is decreased as the filter area is increased compared to a conventional filter that is formed as part of the printhead manifold. While two filters 308A, 308B are depicted, embodiments having more than two filters for filtering more than two ink types are contemplated.

Figure 6:
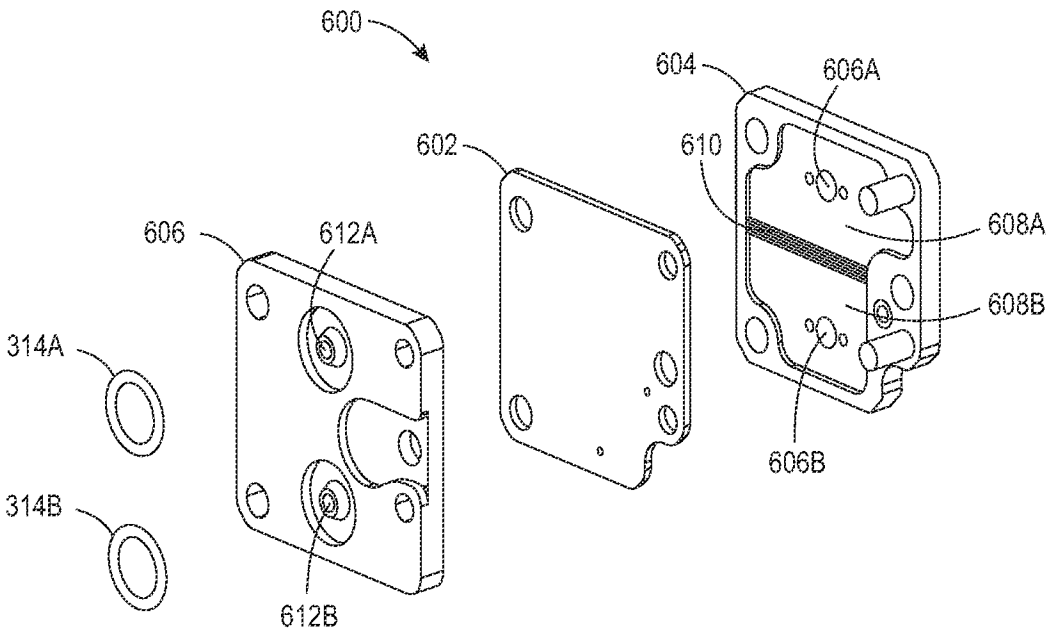
FIG. 6 is an exploded perspective depiction of an external filter assembly having a single filter that filters two ink types in accordance with an embodiment.

FIG. 6 depicts another embodiment for a user-replaceable EFA 600 that uses a single filter 602 to filter one or more inks. While FIG. 6 depicts an EFA 600 that uses one filter 602 to filter two inks, it will be appreciated that a replaceable EFA may be similarly designed with one filter to filter only one ink, or one filter to filter more than two inks. The EFA 600 of FIG. 6 further includes an EFA first plate 604 and an EFA second plate 606. The reverse side of the EFA second plate 606 (not visible in the FIG. 6 depiction) may be flat, or may include one or more cavities, depending on the design.

In the FIG. 6 embodiment, the EFA first plate 604 defines an EFA first ink inlet 606A for introducing a first ink into the EFA 600 and an EFA second ink inlet 606B for introducing a second ink into the EFA 600. The EFA first plate 604 further defines first ink cavity 608A, a second ink cavity 608B, and a ridge 610 that separates the first ink cavity 608A from the second ink cavity 608B. The EFA second plate 606 defines an EFA first ink outlet 612A and an EFA second ink outlet 612B.

During an operation such as printing, the first ink (for example first ink 400A, FIG. 4) enters the EFA 600 through the EFA first ink inlet 606A under the influence of an upstream positive pressure. Because the filter 602 resists the flow of the first ink 400A therethrough, the first ink cavity 608A fills with the first ink 400A. Subsequently, under continuing pressure, the first ink 400A begins to flow through, and be filtered by, the first filter 602, where it then passes through the EFA first ink outlet 612A and into the printhead body 104 (FIG. 2) through the printhead body first ink inlet 200A.

Also during an operation such as printing, the second ink (for example second ink 400B, FIG. 4) enters the EFA 600 through the EFA second ink inlet 606B under the influence of an upstream positive pressure. Because the filter 602 resists the flow of the second ink 400B therethrough, the second ink cavity 608B fills with the second ink 400B. Subsequently, under continuing pressure, the second ink 400B begins to flow through, and be filtered by, the filter 602, where it then passes through the EFA second ink outlet 612B and into the printhead body 104 (FIG. 2) through the printhead body second ink inlet 200B.

During the printing and storage of the first ink 400A and the second ink 400B, pressure and/or adhesive between the ridge 610 and the second plate 606 prevents the two inks from crossing the ridge 610, entering the adjacent cavity, and mixing, or other cross-contamination. Thus in FIG. 6, the ink filter 602 filters both the first ink 400A and the second ink 400B, wherein a separate section of the filter 602 filters each of the first ink 400A and the second ink 400B.

Figure 7:
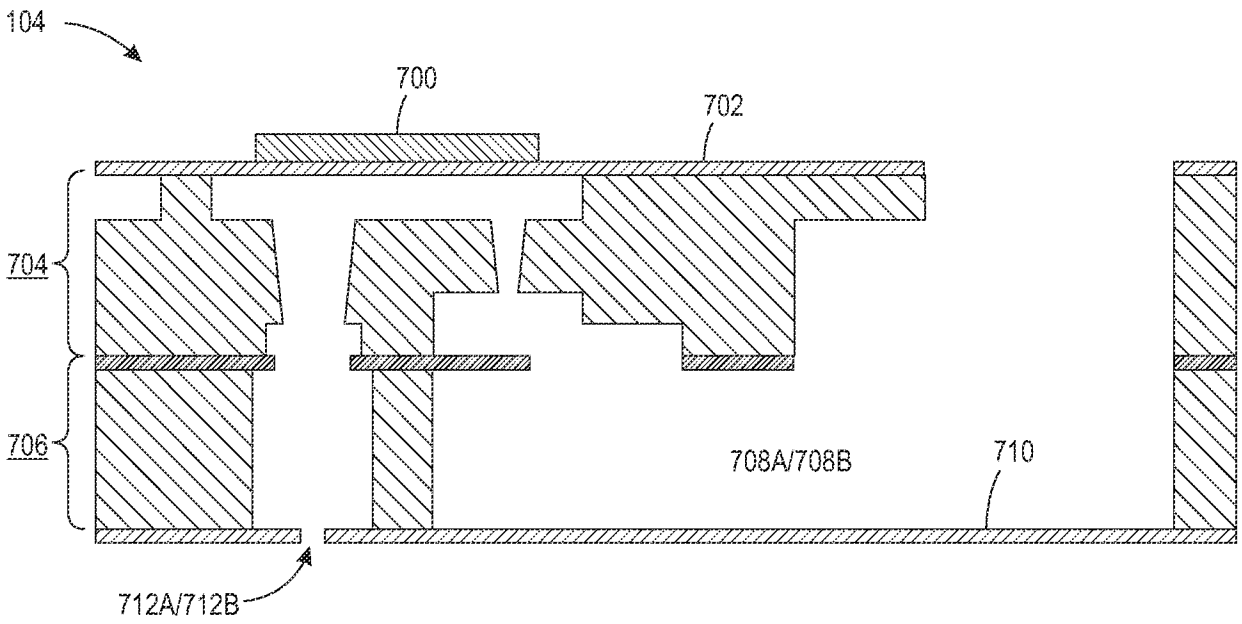
FIG. 7 is a cross section of a portion of a printhead including an actuator for ejecting ink, an ink channel, a nozzle plate, and a nozzle.

FIG. 7 is a schematic depiction of a portion of a printhead body 104 that may be used in an embodiment. While the portion of the printhead body 104 depicted uses piezoelectric actuation to eject ink from a plurality of nozzles in a nozzle plate, it will be understood that an EFA according to the present teachings may be used with other ejection technologies such as thermal ejection, electrostatic ejection, etc. FIG. 7 depicts a piezoelectric actuator 700, a diaphragm 702, an upper manifold 704, a lower manifold 706, and an ink channel 708 through the upper manifold 704 and the lower manifold 706. FIG. 7 further depicts a nozzle plate 710 that defines a nozzle 712. It will be understood that the FIG. 7 structure may be repeated hundreds or thousands of times across an actual printhead body 104, where the nozzle plate 710 defines a plurality of nozzles 712. It will be further apparent to one of ordinary skill in the art that FIG. 7 is a simplified depiction and an actual structure may be formed using a number of laminated layers bonded together with an adhesive, may include other structures that are not depicted for simplicity, while the depicted structures may be removed or modified.

In FIG. 7, for simplicity, the ink channels are referenced as 708A/708B and the nozzles are referenced as 712A/712B. It will be understood that a first plurality of ink channels 708A and a first plurality of nozzles 712A are in fluid communication with the EFA first ink inlet 108A but not the EFA second ink inlet 108B, while a second plurality of ink channels 708B and a second plurality of nozzles 712B are in fluid communication with the EFA second ink inlet 108B but not the EFA first ink inlet 108A.

While the description above describes the EFA 102 with reference to filtering a fluid where the fluid is liquid ink, the EFA 102 may be used for filtering another fluid within a printhead, for example, air or another gas or gases. In an embodiment, the first ink 400A and the second ink 400B may instead be a first fluid 400A and a second fluid 400B, where one of the fluids is a liquid and the other of the fluids is a gas, or where both of the fluids are gases.

Figure 8:
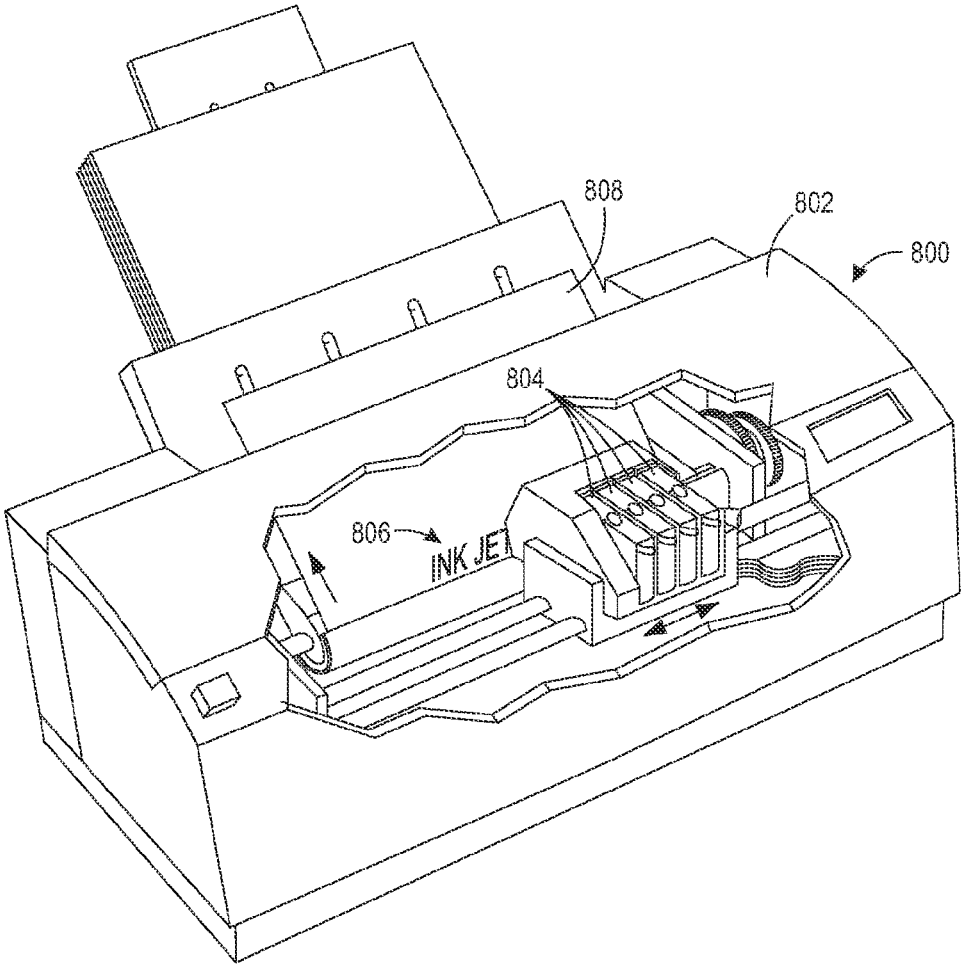
FIG. 8 is a perspective depiction of a printer that includes at least one printhead in accordance with an embodiment.

FIG. 8 depicts a printer 800 including a printer housing 802 into which at least one printhead 804 including an embodiment of the present teachings has been installed. The housing 802 may encase the printhead 804. During operation, ink 806 is ejected from one or more printheads 804. The printhead 804 is operated in accordance with digital instructions to create a desired image on a print medium 808 such as a paper sheet, plastic, etc. The printhead 804 may move back and forth relative to the print medium 808 in a scanning motion to generate the printed image swath by swath. Alternately, the printhead 804 may be held fixed and the print medium 808 moved relative to it, creating an image as wide as the printhead 804 in a single pass. The printhead 804 can be narrower than, or as wide as, the print medium 808. In another embodiment, the printhead 804 can print to an intermediate surface such as a rotating drum, belt, or drelt (not depicted for simplicity) for subsequent transfer to a print medium. While FIG. 8 depicts one type of printer 800, it will be understood that the present teachings may be used in other types of printers, for example industrial printers intended for high volume and high speed.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead, comprising:

a printhead body comprising a first fluid inlet, a first plurality of fluid channels in fluid communication with the first fluid inlet, a second fluid inlet, and a nozzle plate comprising a first plurality of nozzles in fluid communication with the first plurality of fluid channels; and a filter assembly removably attached to the printhead body with at least one mechanical fastener, the filter assembly comprising:

a first plate comprising a first fluid inlet and a second fluid inlet;

a second plate comprising a first fluid outlet in fluid communication with the first fluid inlet of the first plate and a second fluid outlet in fluid communication with the second fluid inlet of the first plate and further in fluid communication with the second fluid outlet of the second plate;

a third plate interposed between the first plate and the second plate;

a second fluid filter interposed between the third plate and the second plate; and a first fluid filter interposed between the first plate and the second plate and further interposed between the first plate and the third plate, wherein;

the first plate, the second plate, the third plate, the first fluid filter, and the second fluid filter are attached together and removably attached to the printhead body by the mechanical fastener; and the first fluid outlet is in fluid communication with the first fluid inlet of the printhead body.

2. The printhead of claim 1, wherein:

the second fluid filter defines at least a portion of a first fluid passthrough channel in fluid communication with the first fluid inlet of the first plate and the first fluid outlet of the third plate; and the first fluid filter defines at least a portion of a second fluid passthrough channel in fluid communication with the second fluid inlet of the first plate and the second fluid outlet of the third plate.

3. The printhead of claim 2, wherein:

the first plate defines a first fluid cavity that is in fluid communication with the first fluid passthrough channel; and the third plate defines a second fluid cavity that is in fluid communication with the second fluid passthrough channel.

4. The printhead of claim 3, further comprising:

a first fluid, wherein the first fluid is located within the first fluid inlet and the first fluid cavity of the first plate, the first fluid passthrough channel defined by the second filter, the first fluid outlet of the second plate, and the first fluid inlet of the printhead body; and a second fluid different from the first fluid, wherein the second fluid is located within the second fluid inlet of the first plate, the second fluid cavity of the third plate, the second fluid passthrough channel defined by the first filter, the second fluid outlet of the second plate, and the second fluid inlet of the printhead body.

5. The printhead of claim 4, wherein:

the first fluid filter is configured to filter particulates from the first fluid but not the second fluid; and the second fluid filter is configured to filter particulates from the second fluid but not the first fluid.

6. The printhead of claim 5, wherein:

the printhead body further comprises a second plurality of fluid channels in fluid communication with the second fluid inlet of the printhead body, the second fluid outlet of the second plate, and the second fluid inlet of the first plate; and the nozzle plate further comprises a second plurality of fluid channels in fluid communication with the second plurality of fluid channels.

7. A printer, comprising:

a printhead comprising:

a printhead body comprising a first fluid inlet, a first plurality of fluid channels in fluid communication with the first fluid inlet, a second fluid inlet, and a nozzle plate comprising a first plurality of nozzles in fluid communication with the first plurality of fluid channels; and a filter assembly removably attached to the printhead body with at least one mechanical fastener, the filter assembly comprising:

a first plate comprising a first fluid inlet and a second fluid inlet;

a second plate comprising a first fluid outlet in fluid communication with the first fluid inlet of the first plate and a second fluid outlet in fluid communication with the second fluid inlet of the first plate and further in fluid communication with the second fluid outlet of the second plate;

a third plate interposed between the first plate and the second plate;

a second fluid filter interposed between the third plate and the second plate; and a first fluid filter interposed between the first plate and the second plate and further interposed between the first plate and the third plate, wherein;

the first plate, the second plate, the third plate, the first fluid filter, and the second fluid filter are attached together and removably attached to the printhead body by the mechanical fastener; and the first fluid outlet is in fluid communication with the first fluid inlet of the printhead body; and a housing that houses the printhead.

8. The printer of claim 7, wherein:

the second fluid filter defines at least a portion of a first fluid passthrough channel in fluid communication with the first fluid inlet of the first plate and the first fluid outlet of the third plate; and the first fluid filter defines at least a portion of a second fluid passthrough channel in fluid communication with the second fluid inlet of the first plate and the second fluid outlet of the third plate.

9. The printer of claim 8, wherein:

the first plate defines a first fluid cavity that is in fluid communication with the first fluid passthrough channel; and the third plate defines a second fluid cavity that is in fluid communication with the second fluid passthrough channel.

10. The printer of claim 9, further comprising:

a first fluid within the first fluid inlet and the first fluid cavity of the first plate, the first fluid passthrough channel defined by the second filter, the first fluid outlet of the second plate, and the first fluid inlet of the printhead body; and a second fluid different from the first fluid within the second fluid inlet of the first plate, the second fluid cavity of the third plate, the second fluid passthrough channel defined by the first filter, the second fluid outlet of the second plate, and the second fluid inlet of the printhead body.

11. The printer of claim 10, wherein:

the first fluid filter is configured to filter particulates from the first fluid but not the second fluid; and the second fluid filter is configured to filter particulates from the second fluid but not the first fluid.

12. The printer of claim 11, wherein:

the printhead body further comprises a second plurality of fluid channels in fluid communication with the second fluid inlet of the printhead body, the second fluid outlet of the second plate, and the second fluid inlet of the first plate; and the nozzle plate further comprises a second plurality of fluid channels in fluid communication with the second plurality of fluid channels.

13. A printhead, comprising:

a printhead body comprising a first fluid inlet, a second fluid inlet, a first plurality of fluid channels in fluid communication with the first fluid inlet, and a nozzle plate comprising a first plurality of nozzles in fluid communication with the first plurality of fluid channels; and a filter assembly removably attached to the printhead body with at least one mechanical fastener, the filter assembly comprising:

a first plate comprising a first fluid inlet, a ridge, a second fluid inlet, a first fluid cavity in fluid communication with the first fluid inlet of the first plate, and a second fluid cavity in fluid communication with the second fluid inlet of the first plate and separated from the first fluid cavity by the ridge;

a second plate comprising a first fluid outlet in fluid communication with the first fluid inlet of the first plate and a second fluid outlet in fluid communication with the second fluid inlet of the first plate, the second cavity, and the second fluid inlet of the printhead body; and a first fluid filter interposed between the first plate and the second plate, wherein the first plate, the second plate, and the first fluid filter are attached together and the first fluid outlet is in fluid communication with the first fluid inlet of the printhead body.

14. The printhead of claim 13, further comprising:

a first fluid within the first fluid inlet of the first plate, the first fluid cavity, the first fluid outlet of the second plate, and the first fluid inlet of the printhead body; and a second fluid different from the first fluid within the second fluid inlet of the first plate, the second cavity, the second fluid outlet of the second plate, and the second fluid inlet of the printhead body.

15. The printhead of claim 14, wherein the first fluid filter is configured to filter contaminates from the first fluid and the second fluid.

16. A printer, comprising:

a printhead comprising:

a printhead body comprising a first fluid inlet, a second fluid inlet, a first plurality of fluid channels in fluid communication with the first fluid inlet, and a nozzle plate comprising a first plurality of nozzles in fluid communication with the first plurality of fluid channels; and a filter assembly removably attached to the printhead body with a mechanical fastener, the filter assembly comprising:

a first plate comprising a first fluid inlet, a ridge, a second fluid inlet, a first fluid cavity in fluid communication with the first fluid inlet of the first plate, and a second fluid cavity in fluid communication with the second fluid inlet of the first plate and separated from the first fluid cavity by the ridge;

a second plate comprising a first fluid outlet in fluid communication with the first fluid inlet of the first plate and a second fluid outlet in fluid communication with the second fluid inlet of the first plate, the second cavity, and the second fluid inlet of the printhead body; and a first fluid filter interposed between the first plate and the second plate, wherein the first plate, the second plate, and the first fluid filter are attached together and the first fluid outlet is in fluid communication with the first fluid inlet of the printhead body; and a housing that houses the printhead.

17. The printer of claim 16, further comprising:

a first fluid within the first fluid inlet of the first plate, the first fluid cavity, the first fluid outlet of the second plate, and the first fluid inlet of the printhead body; and a second fluid different from the first fluid within the second fluid inlet of the first plate, the second cavity, the second fluid outlet of the second plate, and the second fluid inlet of the printhead body.

18. The printer of claim 17, wherein the first fluid filter is configured to filter contaminates from the first fluid and the second fluid.

* * * * *